US012595976B2

(12) United States Patent
Tournois et al.

(10) Patent No.: US 12,595,976 B2
(45) Date of Patent: Apr. 7, 2026

(54) HEAT EXCHANGE SYSTEM

(71) Applicant: VALEO SYSTEMES THERMIQUES, La Verriere (FR)

(72) Inventors: Remi Tournois, La Verriere (FR); Fabien Bireaud, La Verriere (FR); Mathieu Caparros, La Verriere (FR); Jose Trindade, La Verriere (FR)

(73) Assignee: Valeo Systemes Thermiques, Cergy (FR)

( * ) Notice: Subject to any disclaimer, the term of this patent is extended or adjusted under 35 U.S.C. 154(b) by 261 days.

(21) Appl. No.: 18/560,821

(22) PCT Filed: Apr. 7, 2022

(86) PCT No.: PCT/EP2022/059262
§ 371 (c)(1),
(2) Date: Nov. 14, 2023

(87) PCT Pub. No.: WO2022/242955
PCT Pub. Date: Nov. 24, 2022

(65) Prior Publication Data

US 2024/0255237 A1 Aug. 1, 2024

(30) Foreign Application Priority Data

May 20, 2021 (FR) ..... 2105250

(51) Int. Cl.
*F28F 9/00* (2006.01)
*F28D 21/00* (2006.01)
*F28F 9/007* (2006.01)

(52) U.S. Cl.
CPC ..... *F28F 9/002* (2013.01); *F28D 2021/0091* (2013.01); *F28F 2009/004* (2013.01); *F28F 9/007* (2013.01); *F28F 2275/085* (2013.01)

(58) Field of Classification Search
CPC ..... F28F 9/002; F28F 9/007; F28F 2009/004; F28F 2275/085; F28D 2021/0091
(Continued)

(56) References Cited

U.S. PATENT DOCUMENTS 5,219,016 A * 6/1993 Bolton ..... F28F 9/002 165/41
6,237,676 B1 * 5/2001 Hasegawa ..... F28D 1/0435 165/41

(Continued)

FOREIGN PATENT DOCUMENTS

DE 102019216578 A1 4/2021

OTHER PUBLICATIONS

European Patent Office, International Search Report (with English translation) and Written Opinion of corresponding International Application No. PCT/EP2022/059262, dated Jun. 2, 2022.

(Continued)

*Primary Examiner* — Joel M Attey
(74) *Attorney, Agent, or Firm* — Valeo Systemes Thermiques

(57) ABSTRACT

The present invention concerns a heat exchange system including at least one support, a first heat exchanger and a second heat exchanger, each of the first heat exchanger and the second heat exchanger being fixed to the support via a fixing element including at least one tongue. The first heat exchanger includes a first tongue and the second heat exchanger includes a second tongue, the first tongue and the second tongue extending facing one another, each of the first tongue and the second tongue engaging with a common fixing tab of the support.

20 Claims, 3 Drawing Sheets

(58) Field of Classification Search
USPC ..... 165/679
See application file for complete search history.

(56) References Cited

U.S. PATENT DOCUMENTS

| | | | | |
|---|---|---|---|---|
| 6,772,982 | B2 * | 8/2004 | Nakagawa | B60K 11/04 248/233 |
| 7,121,369 | B2 | 10/2006 | Beck et al. | |
| 9,091,468 | B2 * | 7/2015 | Colpan | F28F 9/002 |
| 2004/0069442 | A1 * | 4/2004 | Yagi | F28F 9/002 165/41 |
| 2012/0328390 | A1 * | 12/2012 | Colpan | F25B 39/04 403/345 |
| 2016/0001629 | A1 * | 1/2016 | Rohr | B60K 11/04 165/76 |
| 2017/0167795 | A1 * | 6/2017 | Han | B60K 11/04 |

OTHER PUBLICATIONS

Anonymous, Assembly Snap Feature, Research Disclosure, Kenneth Mason Publications, Hampshire, UK, GB, vol. 476, No. 83, Dec. 1, 2003, XP007133251, ISSN: 0374-4353.

* cited by examiner

HEAT EXCHANGE SYSTEM

TECHNICAL FIELD

The field of the present invention is that of heat exchange systems disposed on at least one fluid distribution circuit and having a plurality of heat exchangers, each capable of carrying out an exchange of heat between an air flow passing through the heat exchange system and a fluid circulating in this heat exchanger.

BACKGROUND OF THE INVENTION

It is known to arrange such a heat exchange system on the front face of a vehicle, such that the heat exchangers of the heat exchange system are passed through in succession by a flow of fresh air coming from the exterior of the vehicle. The heat exchange system can notably have a radiator forming part of a cooling circuit of a combustion engine or of an electric motor and its accessories of the vehicle by exchange of heat between the flow of fresh air and a cooling fluid circulating within it and a condenser which forms part of a thermal regulation loop for the vehicle interior and is capable of ensuring an exchange of heat between a refrigerant fluid circulating within it and the flow of fresh air. It is also known for a sub-cooler fluidically connected to the condenser to be associated with the condenser by means of a cylinder for storing refrigerant fluid in the liquid phase, the sub-cooler also forming part of the thermal regulation loop for the vehicle interior and sub-cooling the refrigerant fluid at the outlet of the storage cylinder.

One known arrangement consists in disposing the radiator, the condenser and the sub-cooler in parallel with one another, perpendicularly to the main direction of circulation of the fresh air coming from the exterior of the vehicle. In this stack, the sub-cooler, having a vertical dimension less than that of the condenser, is the heat exchanger disposed closest to an opening in the front grille of the vehicle, partially overlapping the condenser, and the condenser is disposed between the radiator and the sub-cooler. Such an arrangement of the heat exchange system, although it is particularly efficient in terms of bulk, has the drawback of being difficult to assemble. More specifically, the current way of assembling the heat exchange system, notably with a radiator which is fixed to the vehicle and serves as support for the condenser and furthermore serves as support for the sub-cooler, is tedious and can lack precision, notably on account of the multiplicity of fixing zones for the support, which must engage both with the condenser and the sub-cooler, and can therefore be improved.

BRIEF SUMMARY OF THE INVENTION

The present invention falls within this context and seeks to address the abovementioned drawbacks. To that end, the invention consists of a heat exchange system comprising at least one support, a first heat exchanger and a second heat exchanger, the first heat exchanger and the second heat exchanger each extending in a main plane which is transverse and vertical, the first heat exchanger being disposed, in a longitudinal direction of the heat exchange system, between the support and the second heat exchanger, each of the first heat exchanger and the second heat exchanger being fixed to the support via a fixing element including at least one tongue borne by each of these exchangers and configured to engage with a fixing tab of the support, the heat exchange system being characterized in that the first heat exchanger comprises a first tongue and the second heat exchanger comprises a second tongue, the first tongue and the second tongue each extending from a transverse end of the first heat exchanger and the second heat exchanger, respectively, and facing one another, each of the first tongue and the second tongue engaging with a common fixing tab of the support.

The heat exchange system can notably be received facing a front grille of a vehicle, in this case a motor vehicle. The support can be a radiator forming part of a cooling circuit of the vehicle, the radiator having an exchange surface within which a cooling fluid and an air flow passing through the heat exchange system exchange heat, and lateral collectors for suitable distribution of the cooling fluid. The common fixing tab of the support is then a fixing tab secured to the radiator and more particularly to one of these lateral collectors. The first exchanger can be a condenser which forms part of a thermal regulation loop for the vehicle interior and is intended to cool a refrigerant fluid circulating within it and in this loop by means of the air flow passing successively through the exchangers and the support. The second exchanger can be a sub-cooling element, or sub-cooler, which is disposed fluidically following the condenser, after the cylinder forcing the outlet of the liquid into the thermal regulation loop, the sub-cooler being intended to sub-cool the refrigerant fluid leaving the condenser. In this context, the condenser and the sub-cooler are fluidically connected to one another, for example by means of a storage cylinder intended to collect the refrigerant fluid at the outlet of the condenser in order to distribute it to the sub-cooler.

The first heat exchanger and the second heat exchanger are both fixed to the support, notably by means of the common fixing tab. The first tongue and the second tongue each extend facing one another, that is to say from one and the same transverse end of the heat exchange system, in order that they are able to engage with this common fixing tab.

Such an arrangement of the invention is advantageous in that the bulk of the fixing means of the first heat exchanger and of the second heat exchanger are limited, since said tongues engage with the same fixing tab of the support.

Furthermore, it should be understood that the two heat exchangers are also fixed to the support by additional fixing element, in other zones of the heat exchange system, and notably screwing means.

According to one feature of the invention, each of the first tongue and the second tongue comprises a base and a fixing wall, the base of the first tongue and the base of the second tongue being secured to the first heat exchanger and the second heat exchanger, respectively, the fixing walls each extending from their respective base such that they engage with the common fixing tab of the support.

According to one feature of the invention, the fixing wall of the second tongue comprises a bent zone which extends from its base and a fixing zone which extends from the bent zone, away from the base, the fixing zone extending in a fixing plane parallel to and spaced apart from the main plane, which is transverse and vertical, of the second heat exchanger.

According to one feature of the invention, the bent zone extends towards the support of the heat exchange system. More specifically, the bent zone extends in a bent-zone plane which intersects the fixing plane of the fixing zone of the second tongue.

The result of the above is that the fixing plane of the fixing zone is comprised longitudinally between the main plane of the first heat exchanger and the main plane of the second heat exchanger.

According to one feature of the invention, the fixing wall of the first tongue and the fixing zone of the fixing wall of the second tongue each extend in a plane parallel to the main planes of the first heat exchanger and the second heat exchanger. It will then be understood that the fixing wall of the first tongue and the fixing zone of the fixing wall of the second tongue extend in planes which are parallel to one another.

According to one feature of the invention, the fixing tab of the support extends from a transverse end of the support in the longitudinal direction and comprises at least a first groove and a second groove which are capable of receiving at least part of the first tongue and at least part of the second tongue, respectively.

It will be understood that the fixing tab of the support extends substantially perpendicularly to the tongues. The fixing tab extends longitudinally at least up to the fixing zone of the fixing wall of the second tongue. In other words, the fixing tab extends longitudinally at least between the main plane of the first heat exchanger and the main plane of the second heat exchanger.

According to one feature of the invention, the fixing tab has a free end, away from the support, which extends between the main plane of the first heat exchanger and the main plane of the second heat exchanger. It is thus notable that the longitudinal dimension of the fixing tab is limited, in order that it does not go as far as the main plane of the second heat exchanger. In this way, the fixing tab can exhibit sufficient stiffness to contribute to retaining the first heat exchanger 4 and the second heat exchanger 6 on the support 2.

According to one feature of the invention, the first groove and the second groove are configured to engage with the fixing wall of the first tongue and the fixing zone of the fixing wall of the second tongue, respectively.

According to one feature of the invention, a first vertical end and a second vertical end of the heat exchange system, which are opposite one another in the vertical direction, are defined, each of the first groove and the second groove of the common fixing tab of the support comprising an opening facing one and the same vertical end of the heat exchange system.

More specifically, the first vertical end is the end furthest away from an underbody structure of the vehicle while the second vertical end is the end closest to said underbody structure, when the thermal treatment system is installed within the vehicle. Thus, according to one example of the invention, the openings of the first groove and the second groove face towards the first vertical end, that is to say away from the ground, and the heat exchangers are mounted on the support by way of a vertical movement from top to bottom.

According to one feature of the invention, at least one of the first groove and/or the second groove of the fixing tab comprises a lug protruding from at least one wall contributing to delimiting said first groove and/or said second groove, at least one of the first tongue and the second tongue comprising a receiving slot capable of engaging with said lug.

Each of the first groove and the second groove comprises a bottom wall, opposite its respective opening in the vertical direction. As a result, according to one example of the invention, the lug can protrude from the bottom wall of one and/or the other of the first groove and the second groove of the fixing tab.

An upper edge and a lower edge of each of the first tongue and the second tongue, which face towards the first vertical end and the second vertical end of the heat exchange system, respectively, are also defined. The receiving slot is then formed on one of the lower edges of the first tongue and/or the second tongue, at the fixing walls.

According to one feature of the invention, the fixing wall of the first tongue has a first thickness and the fixing zone of the fixing wall of the second tongue has a second thickness, each of the first thickness and the second thickness being measured longitudinally, the first thickness and the second thickness being different from one another.

According to one feature of the invention, the first groove and the second groove respectively have a first longitudinal dimension slightly greater than the first thickness of the first tongue and a second longitudinal dimension slightly greater than the second thickness of the second tongue.

It will be understood that the tongue thicknesses and the longitudinal dimensions of the grooves form a poka-yoke element for mounting the tongues in the grooves of the fixing tab. In other words, such a feature makes it possible to ensure correct positioning of each of the tongues in the groove intended for it, and it is thus ensured that the first heat exchanger, the condenser in the example mentioned above, is properly disposed between the support, which can notably be the radiator, and the second heat exchanger, which can notably be the sub-cooler mentioned above.

Furthermore, slightly greater is understood to mean a difference which makes it possible to insert the tongues in the grooves with as little mounting play as possible.

According to one example of the invention, the assembly formed by the first thickness of the first tongue and the first longitudinal dimension of the first groove is greater or less than the assembly formed by the second thickness of the second tongue and the second longitudinal dimension of the second groove.

According to one feature of the invention, the common fixing tab of the support comprises, at a free end opposite to the support, an end wall which contributes to delimiting the second groove, the end wall comprising at least one elastically deformable snap-fastening finger arranged through the second groove.

Elastically deformable is understood to mean that the snap-fastening finger is able to deform and then return to its initial position without its material breaking. The snap-fastening finger notably comprises an overthickness which faces towards the support and is disposed partially through the second groove. The overthickness is intended to be in contact with the upper edge of the second tongue when the latter is received in the second groove. The overthickness can for example comprise a chamfer facing towards the first vertical end of the heat exchange system in order to make it easier to guide and insert the second tongue in the second groove.

According to one feature of the invention, each of the bases of each of the tongues has a base thickness considered along a straight line parallel to the longitudinal direction, the base thickness of each of the bases of the first tongue and the second tongue having a value greater than that respectively of the first thickness of the fixing wall of the first tongue and the second thickness of the fixing zone of the fixing wall of the second tongue.

According to one feature of the invention, the common fixing tab of the support comprises a separating wall which extends between the first groove and the second groove, said separating wall comprising an end edge facing towards the first vertical end of the heat exchange system, said separating wall having an end edge chamfer formed at the join between the end edge and the face facing towards the second groove of the fixing tab.

Such an end edge chamfer makes it easier to guide and insert the second tongue in the second groove.

According to one feature of the invention, a first vertical dimension and a second vertical dimension of the fixing wall of the first tongue and of the fixing wall of the second tongue, respectively, are defined, the first vertical dimension being different from the second vertical dimension.

According to one example of the invention, the first vertical dimension of the first tongue is greater than the second vertical dimension of the second tongue, such that the upper edge of the second tongue is received in the second groove in contact with the overthickness of the snap-fastening finger, the latter being in its non-deformed initial position. It will be understood that combining the second vertical dimension with the snap-fastening finger forms a poka-yoke element for the assembly of the heat exchange system.

According to one feature of the invention, the support is a third heat exchanger. The third heat exchanger can be for example the radiator.

According to one feature of the invention, the first heat exchanger and the second heat exchanger have, transversely opposite to the tongues, a first additional fixing element and a second additional fixing element, respectively, the first additional fixing element and the second additional fixing element each being able to engage with an additional fixing element of the support.

The invention also concerns a method for mounting the heat exchange system as described above, during which mounting method, in a first step, the first heat exchanger is disposed by way of a vertical translational movement along the support such that the first tongue is received at least partially in the first groove of the fixing tab of the support, and, in a second step, the second heat exchanger is disposed by way of a vertical translational movement against the first heat exchanger such that the second tongue is received at least partially in the second groove of the fixing tab of the support.

More specifically, in the first step, the first heat exchanger is moved in vertical translation along the support such that the receiving slot of the fixing wall of the first tongue engages with the lug of the first groove. Once the first heat exchanger has been disposed, in the second step, the second heat exchanger is moved in vertical translation against the first heat exchanger such that the fixing zone of the fixing wall of the second tongue comes into contact with the chamfer of the overthickness of the snap-fastening finger of the end wall of the fixing tab, so as to deform said snap-fastening finger in a direction away from the support. In the following text, the upper edge of the second tongue is received under the overthickness such that the snap-fastening finger returns to its non-deformed initial state.

Such mounting of the heat exchange system is advantageous in that it is simplified while still improving the precision of the disposition of the heat exchangers and the support with respect to one another, limiting the number of receiving zones for the tongues of the heat exchangers that are intended to be fixed to the support, and therefore limiting the chain of dimensions and the risks of constraining mounting for the heat exchangers. The durability of the mounting is therefore increased. Furthermore, mounting the two heat exchangers vertically on one and the same fixing tab makes it possible to facilitate assembly by an operator.

BRIEF DESCRIPTION OF THE DRAWINGS

Further features, details and advantages of the invention will become more clearly apparent from reading the description given below by way of indication with reference to the drawings, in which.

DETAILED DESCRIPTION OF THE INVENTION

It should first of all be noted that the figures set out the invention in a detailed manner in order to implement the invention, it being, of course, possible for said figures to serve to better define the invention if necessary.

Figure 1:
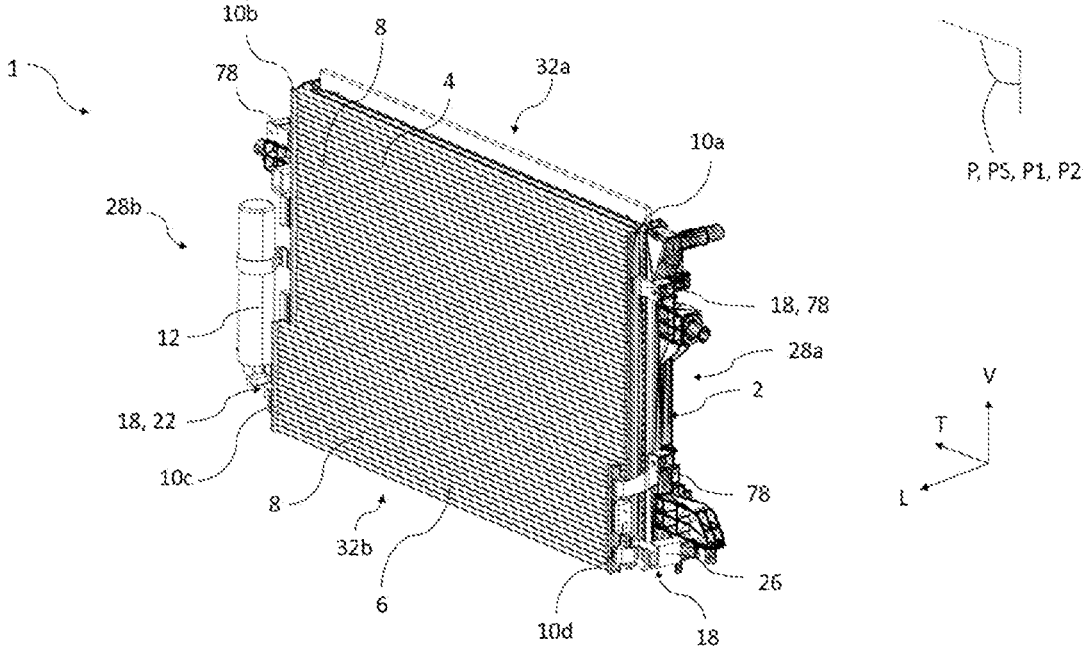
FIG. 1 is a perspective general view of a heat exchange system according to the invention, comprising at least one support, a first heat exchanger and a second heat exchanger.

FIG. 1 illustrates a heat exchange system 1 according to the invention, comprising a support 2, a first heat exchanger 4 and a second heat exchanger 6. Such a heat exchange system 1 is notably intended to be installed on the front face of a motor vehicle, behind a grille for example, in order to be passed through by an air flow while said vehicle is running, the air flow passing successively through the heat exchangers and then the support, perpendicularly to their main plane of extent.

According to one example of the invention, the support 2 of the heat exchange system 1 is a third heat exchanger which here takes the form of a radiator that cools a combustion engine, an electric motor or accessories of the vehicle, and in which a cooling fluid circulates. More specifically, the cooling fluid is intended to receive the heat emitted by the combustion engine as it is operating and then to exchange this heat with the air flow as it circulates in the radiator, in order to return to the combustion engine to resume collecting heat.

Still according to one example of the invention, the first heat exchanger 4 is a condenser and the second heat exchanger 6 is a sub-cooler, a refrigerant fluid at least partially circulating in the heat exchangers.

These two heat exchangers 4, 6 and the support 2 have a parallelepipedal shape and each extend in a main plane P, which is both transverse and vertical according to the reference system L, V, T illustrated in the figures and in which the air flow circulates mainly in the longitudinal direction L, perpendicular to the vertical direction V and transverse direction T. More specifically, the support extends in a support plane PS, the first heat exchanger 4 extends in a first main plane P1 and the second heat exchanger 6 extends in a second main plane P2, said planes PS, P1, P2 being parallel to one another.

The heat exchangers 4, 6 and the support 2 are partially superposed in relation to one another in the longitudinal direction L, namely the main direction of circulation of the air flow, that is to say a direction perpendicular to the main planes P of the heat exchangers 4, 6 and of the support 2. More specifically, the first heat exchanger 4 is disposed longitudinally between the support 2 and the second heat exchanger 6. The heat exchangers 4, 6 and the support 2 are then superposed such that the air flow coming from the exterior of the vehicle passes successively through the second heat exchanger 6, the first heat exchanger 4 and then the support 2 when the vehicle is in operation.

Each of the first heat exchanger 4 and the second heat exchanger 6 has a bundle of tubes 8 or plates depending on the type of heat exchanger, extending mainly transversely and forming a heat exchange zone, in which circulates the refrigerant fluid which allows the exchange of heat between the heat exchangers 4, 6 and the air flow passing through said heat exchangers 4, 6.

The first heat exchanger 4 is delimited transversely by a first side wall 10*a* and a second side wall 10*b*, each side wall 10*a*, 10*b* respectively acting as a fluid distributing chamber at the inlet of the tubes or plates, and as a fluid collecting chamber at the outlet of the tubes or plates. The first side wall 10*a* and the second side wall 10*b* are positioned at a first transverse end 28*a* and at a second transverse end 28*b*, respectively, of the heat exchange system 1.

The second heat exchanger 6 has similar side walls, with a third side wall 10*c* acting as a fluid distributing chamber and a fourth side wall 10*d* acting as a fluid collecting chamber, the side walls being disposed at the second transverse end 28*b* and the first transverse end 28*a*, respectively, of the heat exchange system 1, it being understood that the continuity of circulation of refrigerant fluid from the first heat exchanger 4 to the second heat exchanger 6 implies that the third side wall 10*c* of the second heat exchanger 6 acting as a fluid distributing chamber is disposed at the same second transverse end 28*b* of the heat exchange system 1 as the collecting chamber of the first heat exchanger 4, located at the second side wall 10*b*.

In order to connect the refrigerant circuit portions respectively comprised in each of the first heat exchanger 4 and the second heat exchanger 6 to one another, a receiver-dryer 12 is arranged along a direction of vertical extent V and is secured to attachment flanges, not visible, which themselves are secured to the second side wall 10*b* and the third side wall 10*c*. Furthermore, the first heat exchanger 4 comprises a refrigerant fluid inlet, not visible, which is formed on its first side wall 10*a*, and the second heat exchanger 6 comprises a refrigerant fluid outlet, not visible, which is formed on the fourth side wall 10*c*.

As a result, the refrigerant fluid enters the heat exchange system 1 through the refrigerant fluid inlet located on the first side wall 10*a* of the first heat exchanger 4 and then circulates within the structure of the first heat exchanger 4 via the bundle of tubes 8 to an outlet disposed in the second side wall 10*b* of the first heat exchanger 4. The first heat exchanger 4 is thus configured to ensure an exchange of heat between the refrigerant fluid circulating within it and the air flow passing through it.

The refrigerant fluid is then conducted into the receiver-dryer 12 configured to vertically guide, along its direction of extent, the refrigerant fluid and to bring it to the outlet in the direction of the second heat exchanger 6 at the third side wall 10*c*. The fluid is then able to circulate through the bundle of tubes of the second heat exchanger 6 to the refrigerant fluid outlet located on the fourth side wall 10*d*.

The refrigerant fluid inlet secured to the first heat exchanger 4 and the refrigerant fluid outlet secured to the second heat exchanger 6 are intended to be connected to fluid circulation pipes of the heat exchange system 1 that are not shown here.

Figure 3:
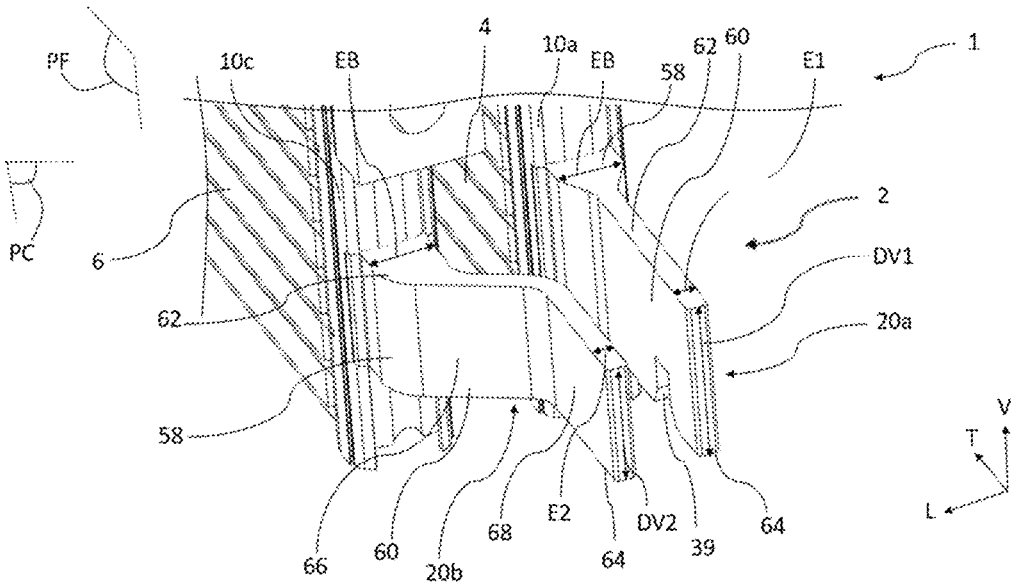
FIG. 3 is a view of details of the heat exchange system of FIG. 1, showing a first tongue and a second tongue of the first heat exchanger and the second heat exchanger, respectively, the tongues being configured to engage with the common fixing tab of the support of FIG. 2.
Figure 4:
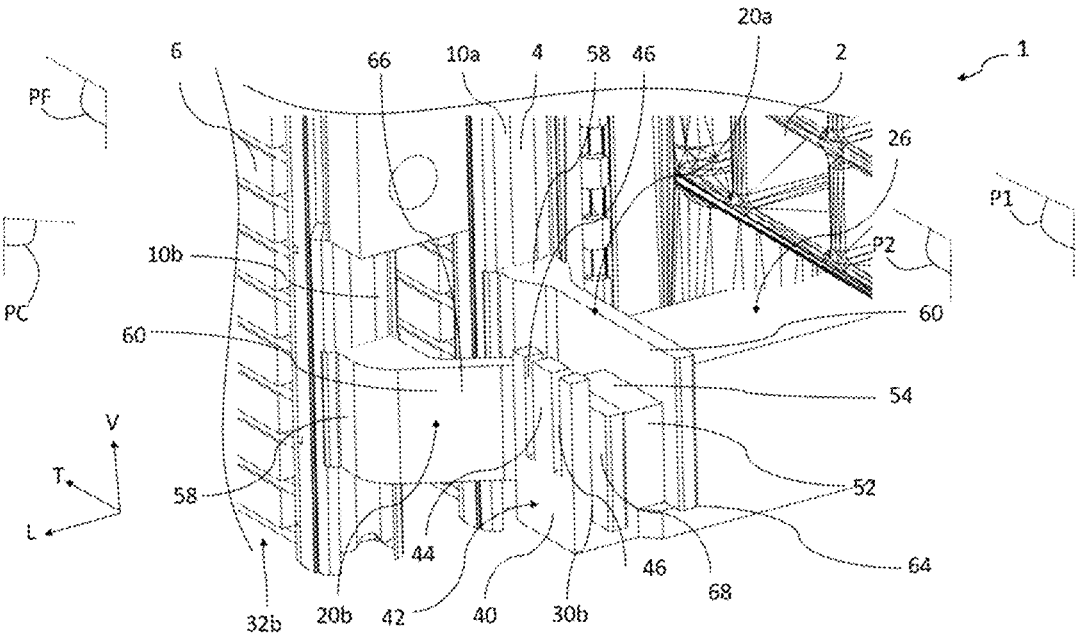
FIG. 4 is a view of details of the engagement between the first tongue and the second tongue of FIG. 3 with the common fixing tab of FIG. 2.

The first heat exchanger 4 and the second heat exchanger 6 are both fixed to the support 2 via the fixing element 18. The fixing element 18 comprises at least one fixing tongue 20 and at least one additional fixing element 22. More specifically, and as can be seen in FIGS. 3 and 4, the first heat exchanger 4 comprises a first fixing tongue 20*a* and the second heat exchanger 6 comprises a second fixing tongue 20*b*, each of the first tongue 20*a* and the second tongue 20*b* extending respectively from the first heat exchanger 4 and the second heat exchanger 6 at the first transverse end 28*a* of the heat exchange system. Expressed differently, each of the first tongue 20*a* and the second tongue 20*b* extends respectively from a transverse end of the first heat exchanger 4 and from a transverse end of the second heat exchanger 6 longitudinally facing one another, at the first transverse end 28*a* of the heat exchange system. According to the illustrated example of the invention, the first tongue 20*a* extends from the first side wall 10*a* of the first heat exchanger 4 and the second tongue 20*b* extends from the fourth side wall 10*d* of the second heat exchanger 6, said tongues 20*a*, 20*b* facing one another.

Figure 2:
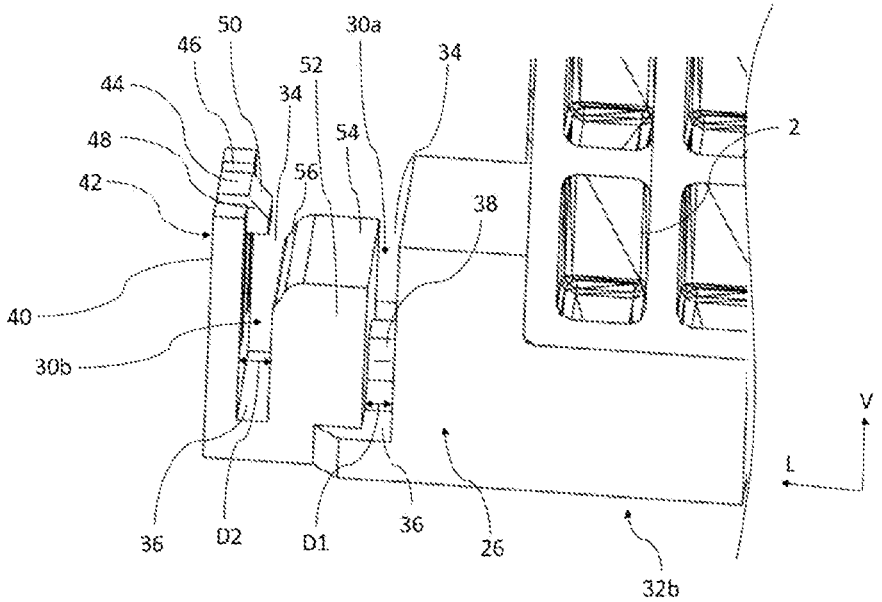
FIG. 2 is a view of details of the heat exchange system of FIG. 1, showing a common fixing tab of the support that is configured to engage with the tongues, not visible here, of the two heat exchangers.

According to the invention, each of the first tongue 20*a* and the second tongue 20*b* engages with a common fixing tab 26 of the support 2, which is particularly visible in FIGS. 2 and 4.

The fixing tab 26 of the support 2 extends from a transverse end of the support 2 disposed at the first transverse end 28*a* of the heat exchange system 1, and extends substantially perpendicularly to the main plane of extent of the support 2, in the longitudinal direction L, such that said fixing tab 26 extends at least facing the first lateral wall 10*a* of the first heat exchanger 4. According to the example of the invention, the longitudinal dimension of the fixing tab 26 is such that the free end, away from the support, of the fixing tab is arranged longitudinally between the first main plane P1 of the first heat exchanger 4 and the second main plane P2 of the second heat exchanger 6.

According to the invention, the fixing tab 26 comprises at least a first groove 30*a* and a second groove 30*b* which are able to receive the first tongue 20*a* and the second tongue 20*b*, respectively, such engagement being set out later on in the detailed description. As can be seen in FIG. 1, the heat exchange system 1 comprises a first vertical end 32*a* and a second vertical end 32*b* which are opposite one another in the vertical direction V of the heat exchange system 1, the first vertical end 32*a* being intended to be the end furthest away from an underbody structure of the vehicle when the heat exchange system 1 is installed within the vehicle. In this context, and as is notably visible in FIG. 2, the first groove 30*a* and the second groove 30*b* of the fixing tab 26 each comprise an opening 34 facing towards the same vertical end of the heat exchange system 1, in this instance the first vertical end 32*a*. A bottom wall 36 of each of the first groove 30*a* and the second groove 30*b* is then defined, each of the bottom walls 36 being vertically opposite the opening 34 of its respective groove 30*a*, 30*b*.

Furthermore, in the illustrated example of the invention, each of the first groove 30*a* and the second groove 30*b* of the fixing tab 26 passes all the way through in the transverse direction T. In other words, each of the grooves extends from one transverse end of the fixing tab 26 to the other.

At least one of the first groove 30*a* and the second groove 30*b* of the fixing tab 26 comprises a lug 38 protruding from at least one side wall contributing to delimiting the first groove 30*a* and/or the second groove 30*b*. The lug 38 has a complementary shape to that of a receiving slot 39, visible in FIG. 3, which is formed on a vertical end edge of one of the tongues 20*a*, 20*b* so as to form a poka-yoke element and ensure that the correct tongue is positioned in the correct groove, the engagement between the tongues 20*a*, 20*b* and the fixing tab 26 being set out later on in the rest of the detailed description. According to the illustrated example of the invention, the lug 38 protrudes from the bottom wall 36 of the first groove 30*a* and, as can be seen in FIG. 3, it is the first tongue 20*a* which has the receiving slot 39.

The fixing tab 26 furthermore comprises a separating wall 52 which extends between the first groove 30*a* and the second groove 30*b* and contributes to delimiting each of them. The separating wall 52 notably comprises an end edge 54 facing towards the first vertical end of the heat exchange system and comprises a chamfered end edge 56 which extends transversely to the join between the end edge 54 and the face contributing to delimiting the second groove 30*b* of the fixing tab 26. It will be understood that such a chamfered end edge 56 of the separating wall 52 makes it possible to facilitate the insertion of the second tongue 20*b* in the second groove 30*b* of the fixing tab 26.

As can be seen in FIGS. 2 and 4, the fixing tab 26 comprises an end wall 40 which extends at a free end 42 of the fixing tab 26, opposite the support 2, and contributes to delimiting the second groove 30*b*.

The end wall 40 comprises at least one elastically deformable snap-fastening finger 44 arranged through the second groove 30*b*. More specifically, the snap-fastening finger 44 extends along the vertical direction V in the end wall 40 and is delimited transversely by two vertical slots 46 formed in the end wall 40 in order to allow the elastic deformation of the snap-fastening finger 44. Elastically deformable is notably understood to mean that the snap-fastening finger 44 is able to deform and then return to its initial position without its material breaking.

The snap-fastening finger 44 furthermore comprises, at its free end disposed away from the bottom wall 36 of the second groove 30*b*, an overthickness 48 which faces towards the support 2 such that said overthickness 48 is arranged through the second groove 30*b* and such that it reduces the passage in the direction of the second groove for the second tongue 20*b* as a result. The passage of the second tongue 20*b* thus tends to deform the snap-fastening finger so as to move the overthickness 48 away from this passage, and the overthickness moves under force in an opposite direction to the support 2 and only resumes its original position when the second tongue is completely inserted in the second groove 30*b*. As illustrated notably in FIG. 2, the overthickness 48 can have a chamfer 50 which extends transversely and makes it easier to guide and insert the second tongue 20*b* in the second groove 30*b*.

The first tongue 20*a* and the second tongue 20*b* and their engagement with the fixing tab 26 will now be described in more detail using FIGS. 2 to 4.

The first tongue 20*a* and the second tongue 20*b* each comprise a base 58 and a fixing wall 60. The base 58 of the first tongue 20*a* and the base 58 of the second tongue 20*b* are secured to the first side wall 10*a* of the first heat exchanger 4 and to the fourth side wall 10*d* of the second heat exchanger 6, respectively. The fixing walls 60 of each of the first tongue 20*a* and the second tongue 20*b* each extend from their respective base 58 such that they engage with the fixing tab 26 of the support 2.

The fixing wall 60 of the first tongue 20*a* extends from its base 58 in the transverse direction T of the heat exchange system and in a main plane which is parallel to the first main plane of the first heat exchanger 4.

The fixing wall 60 of the second tongue 20*b* comprises a bent zone 66 which extends from its base 58 and a fixing zone 68 which extends from the bent zone 66, away from the base. A fixing plane PF in which this fixing zone 68 extends and a bent-zone plane PC in which this bent zone 66 extends are then defined. The fixing plane PF of the fixing zone 68 is parallel to and at a distance from the second main plane P2 of the second heat exchanger 6, while the bent-zone plane PC of the bent zone 66 intersects the fixing plane PF. More particularly, the bent zone 66 extends from the base 58 towards the support 2 such that the fixing zone 68 of the fixing wall 60 of the second tongue 20*b* extends longitudinally between the first main plane P1 of the first heat exchanger 4 and the second main plane P2 of the second heat exchanger 6. In other words, the bent zone 66 makes it possible to move the fixing zone 68 closer to the support 2 in order that said fixing zone 68 engages with the fixing tab 26 of the support 2.

As a result, and as can be seen in FIG. 4, the fixing wall 60 of the first fixing tongue 20*a* engages with the first groove 30*a* of the fixing tab 26 and the fixing zone 68 of the fixing wall 60 of the second tongue 20*b* engages with the second groove 30*b* of said fixing tab 26.

According to the invention, the fixing tab 26 common to a tongue of a first heat exchanger and a tongue of a second exchanger has two separate recesses that are capable of each receiving one of the two tongues, and one of the tongues is configured to be positioned in one of these recesses in spite of the compact longitudinal dimension of the fixing tab which extends facing one of the heat exchangers but not facing the other, notably for reasons of bulk and stiffness of the fixing tab.

In accordance with what was defined above, and notably the first and second vertical ends of the heat exchange system, an upper edge 62 and a lower edge 64 of the first tongue 20*a* and the second tongue 20*b* are defined, the upper edge 62 facing towards the first vertical end while the lower edge 64 faces towards the second vertical end 32*b* of the heat exchange system 1.

As is particularly visible in FIG. 3, the first tongue 20*a* comprises the aforementioned receiving slot 39 which is capable of engaging with the lug 38 of the first groove 30*a*, visible in FIG. 2. The receiving slot 39 is formed from the lower edge 62 of the first tongue 20*a* and has a complementary shape to the lug 38 of the first groove 30*a*.

As indicated above, the flared shape of this receiving slot complements the shape of the lug 38, the inclined plane formed by the flared portion of the slot 39 making it easier to insert the lug in this slot 39.

More specifically, the receiving slot 39 comprises a flared shape in the vicinity of the lower edge 64 of the first tongue 20*a* and a straight shape away from this lower edge 64, and the lug 38, in complementary fashion, comprises a triangular shape in the vicinity of the bottom wall and a straight shape away from this bottom wall. The flared shape makes it possible, in a first step, to guide the mounting of the first tongue 20*a* in the first groove 30*a*, the straight shape of the lug being inserted in the flared shape of the receiving slot. Once the first tongue 20*a* has been inserted in the first groove 30*a*, with the lower edge 64 of the first tongue 20*a* against the bottom wall of the first groove 30*a*, the complementary shapes of the lug 38 and the receiving slot 39 of the first tongue 20*a* make it possible to lock said first tongue 20*a* in position in the first groove 30*a* in the transverse direction T of the heat exchange system 1.

FIG. 3 defines a first vertical dimension DV1 and a second vertical dimension DV2 of the fixing wall 60 of the first tongue 20*a* and of the fixing wall 60 of the second tongue 20*b*, respectively, the vertical dimensions DV1, DV2 being considered along a straight line parallel to the vertical direction V of the heat exchange system. Here, the first vertical dimension DV1 and the second vertical dimension DV2 have values that are different from one another. More specifically, in the example illustrated, the second vertical dimension DV2 has a value lower than that of the first vertical dimension DV1.

The second vertical dimension DV2 of the second tongue 20*b* is defined such that, when the lower edge 64 of the second tongue 20*b* is against the bottom wall of the second groove 30*b*, the upper edge 62 of this second tongue 20*b* is in contact with the overthickness of the snap-fastening finger, this overthickness overlapping the upper edge 62 of the second tongue such that the snap-fastening finger locks said second tongue 20*b* in position in the vertical direction V of the heat exchange system 1.

The difference between the first vertical dimension DV1 and the second vertical dimension DV2 contributes to forming a poka-yoke element of the first tongue 20*a* and the second tongue 20*b* for mounting them on the fixing tab of the support 2, since only the second tongue 20*b*, having said second vertical dimension DV2, is able to be received in the second groove 30*b* with the snap-fastening finger 44 resuming its original position so as to vertically block the tongue present in the second groove.

A first thickness E1 of the fixing wall 60 of the first tongue 20*a* and a second thickness E2 of the fixing zone 68 of the fixing wall 60 of the second tongue 20*b* are also defined, each of the thicknesses E1, E2 being considered along a straight line parallel to the longitudinal direction L of the heat exchange system.

As illustrated in FIG. 2, a first longitudinal dimension D1 of the first groove 30*a* and a second longitudinal dimension D2 of the second groove 30*b*, considered along a straight line which extends in the longitudinal direction L of the heat exchange system, are also defined. It will then be understood that the first longitudinal dimension D1 and the second longitudinal dimension D2 have respectively slightly greater values than the values of the first thickness E1 and the second thickness E2 mentioned above, in order that the first tongue 20*a* can be received and longitudinally retained in the first groove 30*a* and the second tongue 20*a* can be received and longitudinally retained in the second groove 30*a*.

The first thickness E1 and the second thickness E2 can have values that are different from one another, and the first longitudinal dimension D1 and the second longitudinal dimension D2 can correspondingly have values that are different from one another. In this way, it is possible to form another poka-yoke element for ensuring the correct mounting of the first heat exchanger 4 and the second heat exchanger 6 on the support. This is because the heat exchanger with the fixing tongue that has a thickness of greater value than the other fixing tongue cannot be inserted in the groove which is not intended for it.

As can be seen in the exemplary embodiment of the invention, each of the bases 58 of each of the tongues 20*a*, 20*b* has a base thickness EB, considered along a straight line parallel to the longitudinal direction L of the heat exchange system, which is greater than the first thickness E1 and the second thickness E2 of the first tongue 20*a* and the second tongue 20*b*, respectively. Such a feature makes it possible notably to strengthen the tongues 20*a*, 20*b* and more specifically to fix them on their respective heat exchanger 4, 6.

Figure 5:
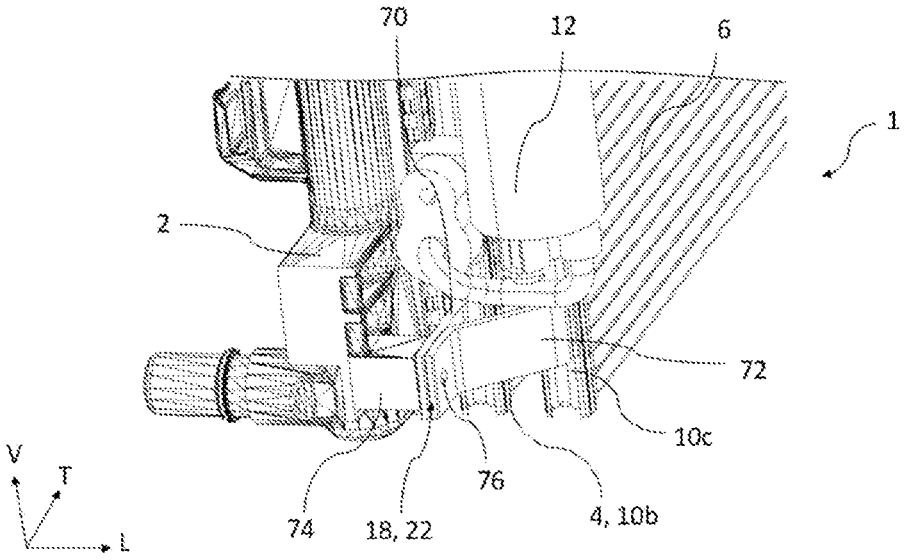
FIG. 5 is a view of details of the heat exchange system of FIG. 1, showing a first additional fixing element and a second additional fixing element of the first heat exchanger and the second heat exchanger, respectively, the additional fixing element of the heat exchangers engaging with an additional fixing element of the support.

The at least one additional fixing element 22 for fixing the first heat exchanger 4 and the second heat exchanger 6 to the support 2 will now be described in more detail with reference to FIGS. 1 and 5.

The first heat exchanger 4 and the second heat exchanger 6 comprise a first additional fixing element 70 and a second additional fixing element 72, respectively. The first additional fixing element 70 and the second additional fixing element 72 extend respectively from the second side wall 10*b* of the first heat exchanger 4 and from the third side wall 10*c* of the second heat exchanger 6 and facing one another.

The first additional fixing element 70 extends in the transverse direction T of the heat exchange system 1 and in a common plane with the first main plane P1 of the first heat exchanger 4. The second additional fixing element 72 extends at least partially in a plane which intersects the second main plane P2 of the second heat exchanger 6 and such that a free end of the second additional fixing element 72 is in contact with the first additional fixing element 70. It will then be understood that the first additional fixing element 70 and the second additional fixing element 72 are in contact with one another and engage with an additional fixing element 74 of the support.

More particularly, each of the first additional fixing element 70 and the second additional fixing element 72 comprises a fixing orifice 76, the orifices being formed facing one another and facing a tapped orifice, not visible, of the additional fixing element 74 of the support, such that a fixing screw can secure the two additional fixing elements to the additional fixing element 74 of the support at the same time. The fixing of the first heat exchanger 4 and the second heat exchanger 6 to the support 2 at the second transverse end 28*b* of the heat exchange system, transversely opposite the fixing tongues 20*a*, 20*b*, is thus enabled.

It will furthermore be understood that the fixing elements 18 for fixing the first heat exchanger 4 and of the second heat exchanger 6 to the support 2 are not limited to those described in the present application and can comprise other fixing elements 18 such as pierced fixing walls 78, depicted in FIG. 1, that are able to engage with the fixing holes formed on the support. These pierced fixing walls 78 are notably arranged on the heat exchange system 1 vertically away from the tongues 20*a*, 20*b* and the additional fixing element 22 in order to ensure optimum retention of the first heat exchanger 4 and the second heat exchanger 6 on the support 2 by distributing the fixing element vertically between the first vertical end 32*a* and the second vertical end 32*b* of the heat exchange system 1.

A method for mounting the heat exchange system 1 will now be described in relation to FIGS. 1 to 5.

The mounting method notably comprises a first step, during which the first heat exchanger 4 is disposed by way of a vertical translational movement along the support 2 such that the first tongue 20*a* is received at least partially in the first groove 30*a* of the fixing tab 26. More specifically, the first heat exchanger 4 is moved in vertical translation such that the fixing wall 60 of the first tongue 20*a* is received in the first groove 30*a*. The vertical displacement of the first heat exchanger continues until the first heat exchanger is in a final position, with the lower edge of the first tongue being in contact with the bottom wall of the first groove 30*a*, this being made possible by the engagement between the shapes of the receiving slot 39 and the lug 38.

In this final position, the additional fixing element 22 and the at least one pierced fixing wall 78 of the first heat exchanger 20*a* are opposite the associated fixing element of the support and an intermediate screwing step can take place at the pierced fixing wall to ensure the position of the first heat exchanger 4 while the second heat exchanger is being installed.

The second heat exchanger 6 is then disposed by way of a vertical translational movement against the first heat exchanger 4 such that the second fixing tongue 20*b* is received at least partially in the second groove 30*b* of the fixing tab 26. More specifically, the second heat exchanger 6 is moved in vertical translation such that the fixing zone 68 of the fixing wall 60 of the second tongue 20*b* comes into contact with the chamfer 50 of the overthickness 48 of the snap-fastening finger 44 and deforms said snap-fastening finger 44 in the opposite direction to the support 2. Such a deformation of the snap-fastening finger 44 enables the passage of the fixing zone 68 of the fixing wall 60 of the second tongue 20*b*, guided by the chamfer of the end edge 56 of the separating wall 52. The vertical displacement of the second heat exchanger continues until the second heat exchanger is in a final position, with the lower edge of the second tongue being in contact with the bottom wall of the second groove 30*b*, the snap-fastening finger then resuming its initial position and the overthickness 48 then locking the second tongue 20*b* in position.

In this final position, the additional fixing element 22 of the second heat exchanger 20*b* is opposite the additional fixing element 22 of the first heat exchanger 20*b* and a tightening screw can secure the two heat exchangers to one and the same support unit via a tapped orifice common to the two heat exchangers.

As has just been described, both for the mounting method and for the structure of the heat exchange system, it will be understood that the structures of the fixing tongues 20*a*, 20*b* and of the fixing tab 26 are advantageous in that they ensure simple mounting of the heat exchange system 1 by notably allowing the vertical assembly of the first heat exchanger 4 and the second heat exchanger 6 for fixing them to one and the same fixing tab 26 of the support 2.

The invention is not intended to be limited to the means and configurations exclusively described and illustrated, however, but also applies to all the equivalent means or configurations and to any combination of such means or configurations.

What is claimed is:

1. A heat exchange system comprising at least one support, a first heat exchanger and a second heat exchanger, the first heat exchanger and the second heat exchanger each extending in a main plane which is transverse and vertical, the first heat exchanger being disposed, in a longitudinal direction of the heat exchange system, between the at least one support and the second heat exchanger, each of the first heat exchanger and the second heat exchanger being fixed to the at least one support wherein the first heat exchanger includes a first tongue and the second heat exchanger includes a second tongue, the first tongue and the second tongue each extending from a transverse end of the first heat exchanger and the second heat exchanger, respectively, and facing one another, each of the first tongue and the second tongue engaging with a fixing tab of the at least one support, and wherein the fixing tab of the at least one support includes at least a first groove and a second groove which are capable of receiving at least part of the first tongue and at least part of the second tongue, respectively.

2. The heat exchange system according to claim 1, wherein each of the first tongue and the second tongue includes a base and a fixing wall, the base of the first tongue and the base of the second tongue being secured to the first heat exchanger and the second heat exchanger, respectively, the fixing walls each extending from their respective base such that they engage with the fixing tab of the at least one support.

3. The heat exchange system according to claim 2, wherein the fixing wall of the second tongue includes a bent zone which extends from its base and a fixing zone which extends from the bent zone, away from its base, the fixing zone extending in a fixing plane parallel to and spaced apart from the main plane, which is transverse and vertical, of the second heat exchanger.

4. The heat exchange system according to claim 3, wherein the bent zone extends towards the at least one support of the heat exchange system.

5. The heat exchange system according to claim 2, wherein the fixing wall of the first tongue and the fixing zone of the fixing wall of the second tongue each extend in a plane parallel to the main planes of the first heat exchanger and the second heat exchanger.

6. The heat exchange system according to claim 1, wherein the fixing tab of the at least one support extends from a transverse end of the at least one support in the longitudinal direction.

7. The heat exchanger system according to claim 1, wherein each of the first tongue and the second tongue includes a base and a fixing wall, the base of the first tongue and the base of the second tongue being secured to the first heat exchanger and the second heat exchanger, respectively, the fixing walls each extending from their respective base such that they engage with the fixing tab of the at least one support, wherein the first groove and the second groove are configured to engage with the fixing wall of the first tongue and the fixing zone of the fixing wall of the second tongue, respectively.

8. The heat exchange system according to claim 1, wherein a first vertical end and a second vertical end of the heat exchanger system, which are opposite one another in the vertical direction, are defined, each of the first groove and the second groove of the fixing tab of the at least one support including an opening facing one and the same vertical end of the heat exchange system.

9. The heat exchange system according to claim 1, wherein the fixing tab of the at least one support includes, at a free end opposite to the at least one support, an end wall which contributes to delimiting the second groove, the end wall including at least one elastically deformable snap-fastening finger arranged through the second groove.

10. A method for mounting a heat exchange system including at least one support, a first heat exchanger and a second heat exchanger, the first heat exchanger and the second heat exchanger each extending in a main plane which is transverse and vertical, the first heat exchanger being disposed, in a longitudinal direction of the heat exchange system, between the at least one support and the second heat exchanger, each of the first heat exchanger and the second heat exchanger being fixed to the at least one support wherein the first heat exchanger includes a first tongue and the second heat exchanger includes a second tongue, the first tongue and the second tongue each extending from a transverse end of the first heat exchanger and the second heat exchanger, respectively, and facing one another, each of the first tongue and the second tongue engaging with a fixing tab of the at least one support, the method comprising disposing the first heat exchanger by way of a vertical translational movement along the at least one support such that the first tongue is received at least partially in the first groove of the fixing tab of the at least one support, and disposing the second heat exchanger by way of a vertical translational movement against the first heat exchanger such that the second tongue is received at least partially in the second groove of the fixing tab of the at least one support.

11. A heat exchange system comprising:

a first heat exchanger and a second heat exchanger, the first heat exchanger being disposed, in a longitudinal direction of the heat exchange system, between at least one support and the second heat exchanger;

wherein the first heat exchanger includes a first tongue and the second heat exchanger includes a second tongue, the first tongue and the second tongue each extending from a transverse end of the first heat exchanger and the second heat exchanger, respectively, and facing one another, each of the first tongue and the second tongue engaging with a fixing tab of the at least one support, and wherein the fixing tab of the at least one support extends from a transverse end of the at least one support in the longitudinal direction and includes at least a first groove and a second groove which are capable of receiving at least part of the first tongue and at least part of the second tongue, respectively.

12. The heat exchange system according to claim 11, wherein each of the first heat exchanger and the second heat exchanger are fixed to the at least one support.

13. The heat exchange system according to claim 11, wherein each of the first heat exchanger and the second heat exchanger extend in a main plane which is transverse and vertical.

14. The heat exchange system according to claim 11, wherein the fixing tab of the at least one support includes, at a free end opposite to the at least one support, an end wall which contributes to delimiting the second groove, the end wall including at least one elastically deformable snap-fastening finger arranged through the second groove.

15. The heat exchange system according to claim 13, wherein each of the first tongue and the second tongue includes a base and a fixing wall, the base of the first tongue and the base of the second tongue being secured to the first heat exchanger and the second heat exchanger, respectively, the fixing walls each extending from their respective base such that they exchange with the fixing tab of the at least one support.

16. The heat exchange system according to claim 13, wherein the fixing tab includes a lug protruding from at least one wall that contributes to delimiting the first groove and/or the second groove.

17. The heat exchange system according to claim 15, wherein the fixing wall of the second tongue includes a bent zone which extends from its base and a fixing zone which extends from the bent zone, away from its base.

18. The heat exchange system according to claim 16, wherein at least one of the first tongue and the second tongue include a receiving slot capable of engaging with the lug.

19. The heat exchange system according to claim 17, wherein the bent zone extends towards the at least one support of the heat exchange system.

20. The heat exchange system according to claim 17, wherein the fixing zone extends in a fixing plane parallel to and spaced apart from the main plane, which is transverse and vertical, of the second heat exchanger.

* * * * *